US008766895B2

(12) United States Patent
Jung

(10) Patent No.: US 8,766,895 B2
(45) Date of Patent: Jul. 1, 2014

(54) DRIVING METHOD, COMPENSATION PROCESSOR AND DRIVER DEVICE FOR LIQUID CRYSTAL DISPLAY

(75) Inventor: Chulgyu Jung, Beijing (CN)

(73) Assignee: Bejing Boe Optoelectronics Technology Co., Ltd., Beijing (CN)

( * ) Notice: Subject to any disclaimer, the term of this patent is extended or adjusted under 35 U.S.C. 154(b) by 1113 days.

(21) Appl. No.: 12/267,671

(22) Filed: Nov. 10, 2008

(65) Prior Publication Data

US 2009/0243986 A1 Oct. 1, 2009

(30) Foreign Application Priority Data

Mar. 28, 2008 (CN) ..... 2008 1 0102996

(51) Int. Cl.
*G09G 3/36* (2006.01)

(52) U.S. Cl.
USPC ..... 345/94; 345/102; 345/690; 345/87

(58) Field of Classification Search
None
See application file for complete search history.

(56) References Cited

U.S. PATENT DOCUMENTS

2006/0109234 A1* 5/2006 Hong et al. ..... 345/102
2007/0296686 A1* 12/2007 Yoo ..... 345/102
2008/0030450 A1* 2/2008 Yamagishi et al. ..... 345/89
2009/0015601 A1* 1/2009 Kim ..... 345/690

* cited by examiner

*Primary Examiner* — Jesus Hernandez
(74) *Attorney, Agent, or Firm* — Ladas & Parry LLP

(57) ABSTRACT

The invention relates to a driving method, compensation processor and driver device for liquid crystal display. The driving method includes steps of receiving data signal of a present frame; obtaining an average brightness value of the present frame; comparing the previous frame with the present frame, and when the difference between the average brightness values is larger than or equal to a set threshold, generating at least two back light driver pulse signals of which the duty ratios gradually changing, and outputting them to drive the back lights. The compensation processor includes a data analysis module, a data compensation module, a back light linear filtering module and a pulse generator module. The driver device employs the compensation processor of the present invention. The present invention employs the technical means of generating a plurality of back light driver pulse signals, realizes the gradual changing of the brightness of the back lights, and overcomes the picture flickering problem due to the sudden changing of the brightness of the back lights, thus improving the display effect of the LCD.

8 Claims, 8 Drawing Sheets

DRIVING METHOD, COMPENSATION PROCESSOR AND DRIVER DEVICE FOR LIQUID CRYSTAL DISPLAY

FIELD OF THE INVENTION

This invention relates to a driving method, compensation processor and driver device for liquid crystal display, and particularly to a driving method for analyzing and then compensating video data input to liquid crystal display, a compensation processor for implementing the analysis and compensation, and a driver device utilizing the compensation processor.

DESCRIPTION OF THE PRIOR ART

Liquid crystal display, especially the Thin Film Transistor-Liquid Crystal Display (TFT-LCD) has the advantages of low weight, low thickness, low power consumption, suitable for low voltage driving and so on, and is widely used in various image display media apparatus such as mobile phone, monitor, TV, etc.

The main structure of the common LCD at present includes an array substrate and a color film substrate set to box as a liquid crystal panel, and liquid crystal material is filled therebetween. A plurality of back lights are set under the array substrate, and light supplied from the back lights enter via the array substrate on liquid crystal layer, and emit from the color film substrate after effecting on liquid crystal layer. Data lines and gate electrode scan lines are crossly set on the array substrate, and the crossed area is formed as a pixel unit. The back lights may correspond to a plurality of pixel units, such as Cold Cathode Fluorescent Lamp (CCFL). Alternatively, the back lights may be set corresponding to each of pixel units, e.g., a plurality of Light Emitting Diode (LED) is set. TFT switch element is set within each of pixel units. Data signals and scan pulses are input to the data lines and the gate electrode scan lines respectively by the driver device for the driving, while the back lights are driven to lighten, and the displaying of images of each frame are realized. As can be seen, the driver device of the LCD is one of the essential components for determining the effect of image display.

FIG. 1 shows a structural diagram of prior LCD. Firstly, data lines and gate electrode scan lines are set on the array substrate 10, the back lights 60 are set under the array substrate 10. In detail, the driver device includes: a data driver 20 comprising a plurality of data driver IC connected with the data lines respectively, for providing data signals to data lines; a scan driver 30 comprising a plurality of gate driver IC connected with the gate electrode scan lines respectively, for providing scan pulses to the gate electrode scan lines; an inverter 70 connected with each of the back lights 60 respectively, for making transformation between DC and AC according to back light driver pulse signal, and driving and controlling the back lights 60, wherein the inverter 70 can drive the back lights 60 to lighten and control the brightness of the back lights 60, and the back lights 60 can emit light at a set brightness according to the control of the inverter 70; a timing controller 40 connected with the data driver 20 and the scan driver 30 respectively, for generating timing signals for controlling the data driver 20 and the scan driver 30, wherein the timing controller 40 generates data timing signals (OE, TP, STH, and CPH) required for the data driver 20 and scan timing signals (STV and CPV) required for the scan driver 30 according to the synchronous signals including horizontal synchronous signal, vertical synchronous signal, and data enable signal input from the system 100; a transformer (DC/DC) 80 connected with the data driver 20, the scan driver 30, and the inverter 70 respectively, for converting an input high voltage to a voltage required for the liquid crystal panel and supplying the required voltage to respective sections, e.g., analog voltage and digital voltage are supplied to the data driver 20, and "VGH" and "VGL" voltages are supplied to the scan driver 30. Wherein the data driver 20 stores the received data signal into a latch according to the data timing signal, converts the data signal to a gammar voltage required for the LCD through a digital to analog converter (DAC), and outputs it to the TFT switch element. The scan driver 30 converts and generates a switch voltage of the gate electrode according the scan timing signal and the "VGH", "VGL" voltages generated in the transformer 80, i.e., a scan pulse, and outputs it to the TFT switch element through the gate electrode scan lines.

For realizing a better display effect and prevent the picture from jittering, a compensation processor 50 also referred to as Dynamic Contrast Ratio (DCR) control module) is typically set in the prior driver device, for compensating for the data signals, changing the transmissivity of the liquid crystal. In detail, the compensation processor 50 comprises a data analysis module 51, a data compensation module 52, a back light control module 53 (BLU controller) and a pulse generator module 54 (PWM generator), as shown in FIG. 1. The operation process of the compensation processor 50 is that: the data analysis module 51 firstly receives the data signal sent from the system 100 via "Data Resfer (Rx)", then makes a spectrum analysis on the data signals, thus obtaining a result of the analysis, and corresponding to the analysis, obtains and records the average brightness value which the present frame should have; the data compensation module 52 is for compensating and changing the data signal according to the result of the spectrum analysis, then outputting it to the data driver 20 via a Data Transceiver (Tx). The back light controller module 53 is connected with the data analysis module 51, for obtaining the average brightness value of the present frame, i.e., average gray scale level, and correspondingly obtaining the compensation on the data signal according to the result of the spectrum analysis, then determining the required brightness value of the back light, and generating a pulse generation instruction and sending it to the pulse generator module 54. The pulse generator module 54 generates back light driver pulse signal according to the pulse generation instruction, and outputs it to the inverter 70, thus adjusting the brightness of the back lights 60 through the change of the duty ratio of the back light driver pulse signal. The comparison before and after the compensation on the data signal is shown in FIG. 2*a*, the compensation on the data signal is actually that adjusting the transmissivity of the liquid crystal according to the Gammar voltage, i.e., adjusting the working voltage value applied on both sides of the liquid crystal layer. The abscissa in FIG. 2*a* is the gray scale level of the data signal, and ordinate in FIG. 2*a* is the corresponding working voltage value of the data signal, wherein increasing the working voltage value of the data signal can increase the gray scale displayed on the pixel unit. The gray scale of the pixel unit is determined by both of the transmissivity of the liquid crystal and the brightness of the back lights. FIG. 2*b* shows the adjustment of the brightness of the back lights made corresponding to the compensation and adjustment of the data signal. Because the transmissivity of the liquid crystal is increased, the brightness of the back lights may be decreased correspondingly, the brightness difference L of the adjustment is referred to as a Dimming Range.

However, the prior LCD employing the driving method by using the Dynamic Contrast technology has the disadvantage in that: although the data signal may be compensated for by analyzing the spectrum of the data signal, thus changing the output data signal according to the set driving frequency, because the change of the brightness of the back lights has the stepwise characteristic and is not smooth, a sudden changing of the brightness of the back lights will occur in the picture of neighboring frames after said compensation and adjustment, which may cause the appearance of flicking, and thus degrading the display effect of the LCD.

As in the case of FIG. 3, in the procedure of gradually increasing the white area of the picture, the data signal will be subjected to the spectrum analysis, and then subjected to the compensation, thus the transmissivity of the liquid crystal is adjusted, while the brightness of the back lights is adjucted. As can be seen from FIGS. 3*a*, 3*b* and 3*c*, as the picture changes, both of the transmissivity of the liquid crystal and the brightness of the back lights are increased, wherein FIG. 3*b* shows the change of the ideal brightness value of the picture, and FIG. 3*c* shows the actual change of the brightness value of the picture after the cooperation of the back lights and the liquid crystal. If 8-bit digital pulse is used as the back light driver pulse signal, the brightness may have 256 levels for the change. When the white color in the picture is increased gradually, and the brightness is increased, even if the brightness changes from the lowest level to the highest level by 10 times, each level will comprise 25.6 levels, and people may still feel the flicking of the picture.

SUMMARY OF THE INVENTION

An object of the invention is to provide a driving method, compensation processor and driver device for LCD, for eliminating the flicking occurring on the LCD.

In order to realize the above object, the invention provides a driving method for LCD, comprising:

Step 1 of receiving data signal of a present frame, making spectrum analysis on the data signal, obtaining and recording an average brightness value of the present frame;

Step 2 of acquiring the average brightness value of the present frame, and querying an average brightness value of the previous frame to compare with the average brightness value of the present frame;

Step 3 of when the result of the comparison is that a difference value between the average brightness value of the previous frame and the average brightness value of the present frame is larger than or equal to a set threshold, a pulse generation instruction is generated for indicating to generate at least two back light driver pulse signals in sequence. The relation between the duty ratios of respective back light driver pulse signals is an unidirectional gradual changing, and the direction of the unidirectional gradual changing is the same as the direction of the average brightness value of the previous frame gradually changing to the average brightness value of the present frame;

Step 4 of generating the back light driver pulse signals according to the pulse generation instruction, and outputting each of the back light driver pulse signals in sequence to drive the back lights.

In order to realize the above object, the invention further provides a compensation processor for LCD, comprising:

A data analysis module for receiving data signal of a present frame, making a spectrum analysis on the data signal, obtaining and recording an average brightness value of the present frame;

A data compensation module connected with the data analysis module, for generating data compensation signal according to the result of the spectrum analysis, and outputting the generated data compensation signal to a data driver of the LCD;

A back light linear filtering module connected with the data analysis module, for acquiring an average brightness value of the previous frame to compare with the average brightness value of the present frame, and when the result of the comparison is that a difference between the average brightness value of the previous frame and the average brightness value of the present frame is larger than or equal to a set threshold, generating a pulse generation instruction indicating to generate at least two back light driver pulse signals in sequence, wherein the relation between duty ratios of respective back light driver pulse signals is the unidirectional gradual changing, and the direction of the unidirectional gradual changing is the same as the direction of the average brightness value of the previous frame gradually changing to the average brightness value of the present frame;

A pulse generator module connected with the back light linear filtering module, for generating the back light driver pulse signals according to the pulse generation instruction, and outputting each of the back light driver pulse signals in sequence to drive the back lights.

In order to realize the above object, the invention further provides a driver device for LCD by using the compensation processor for the LCD of the invention, further comprising: a data driver; a scan driver; an inverter; a timing controller connected with the data driver and the scan driver respectively; a transformer, wherein the data compensation module of the compensation processor is connected with the data driver; the pulse generator module of the compensation processor is connected with the inverter.

As can be seen from above solutions, the invention employs the technical means of generating a plurality of back light driver pulse signals, realizes the gradual changing of the brightness of the back lights, thus overcomes the picture flickering problem due to the sudden changing of the brightness of the back lights. Therefore, the solution of the invention can improve the display effect of the LCD and increase the dynamic contrast of the image display.

Hereinafter, the invention will be described in details by means of the embodiments in conjunction with the drawings.

ELEMENTS LIST

Figure 1:
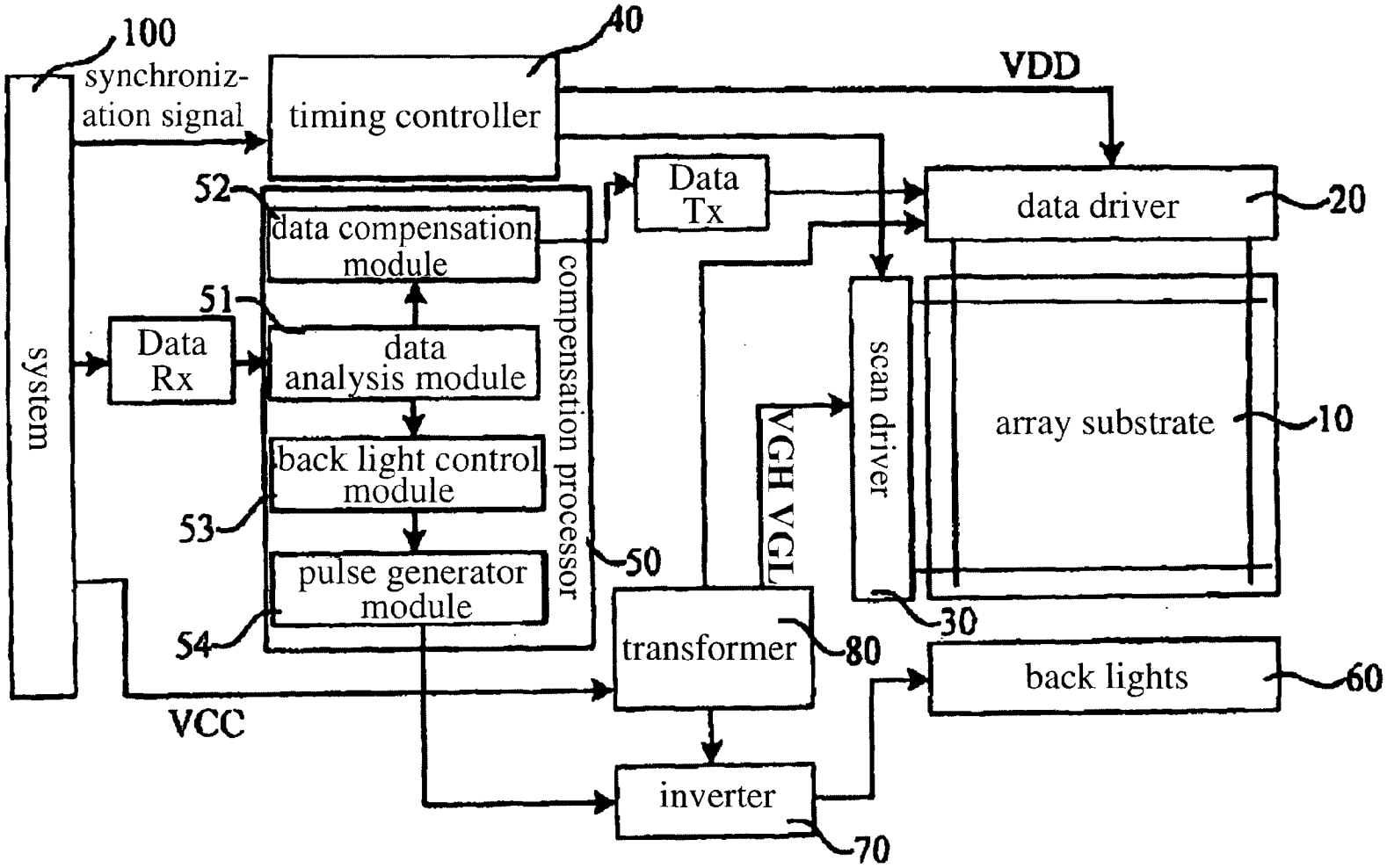
FIG. 1 is a structural schematic diagram of the driver device for the LCD of the prior art.
Figure 2A:
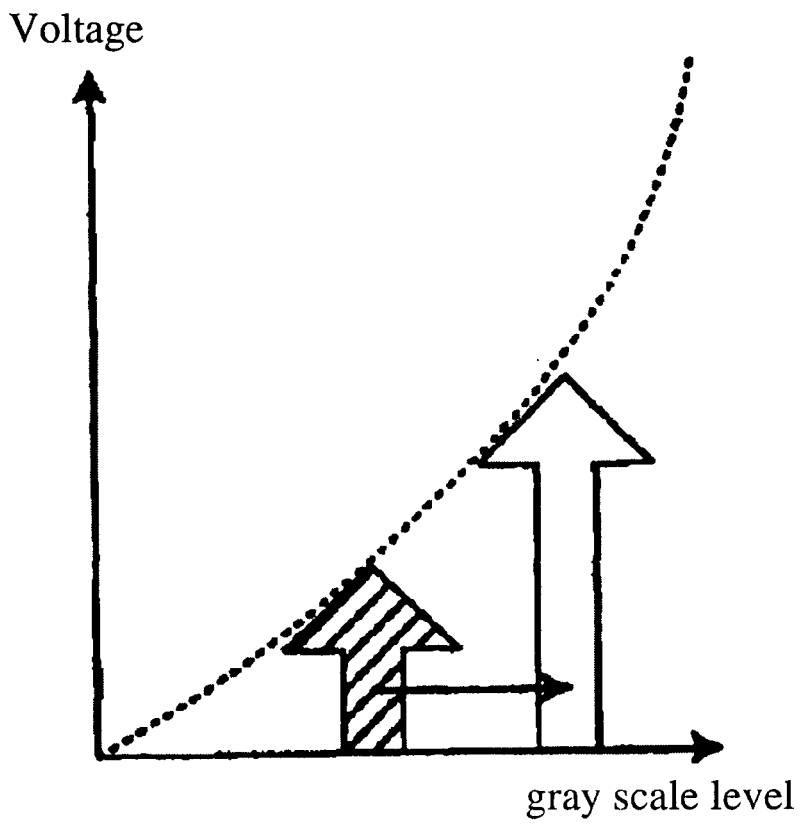
FIG. 2*a* is a schematic diagram of the compensation adjustment of the data signal in the prior dynamic contrast control technology.
Figure 2B:
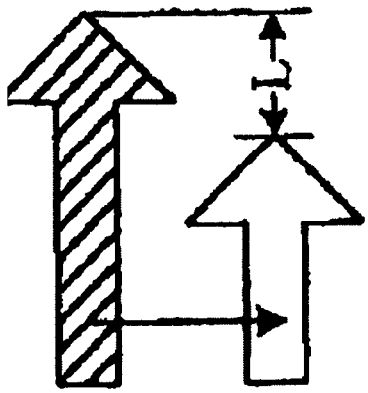
FIG. 2*b* is a schematic diagram of the adjustment of the back lights in the prior dynamic contrast control technology.
Figure 3A:
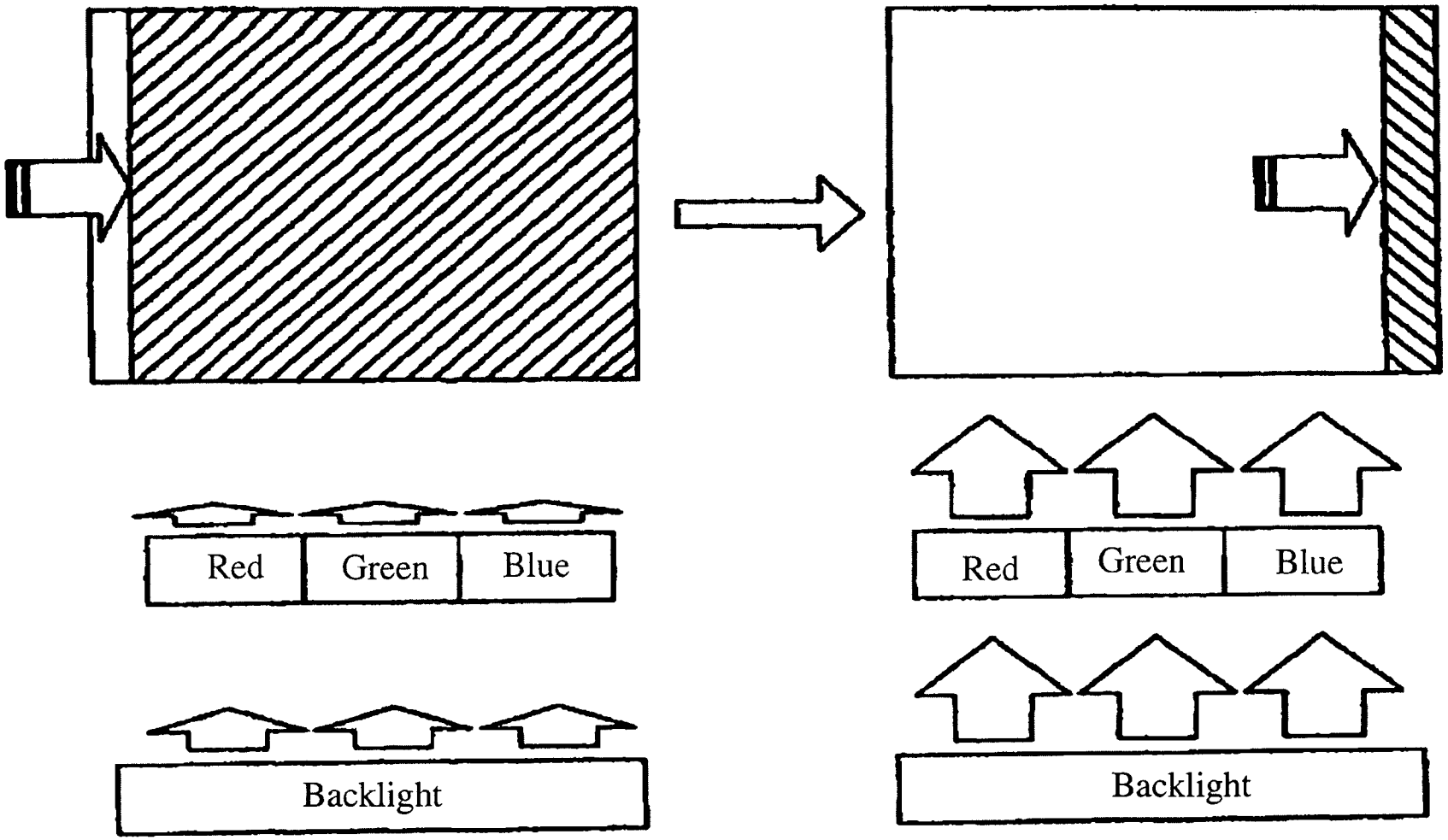
FIG. 3*a* is a schematic diagram of a picture changing from black to white in the prior art.
Figure 3B:
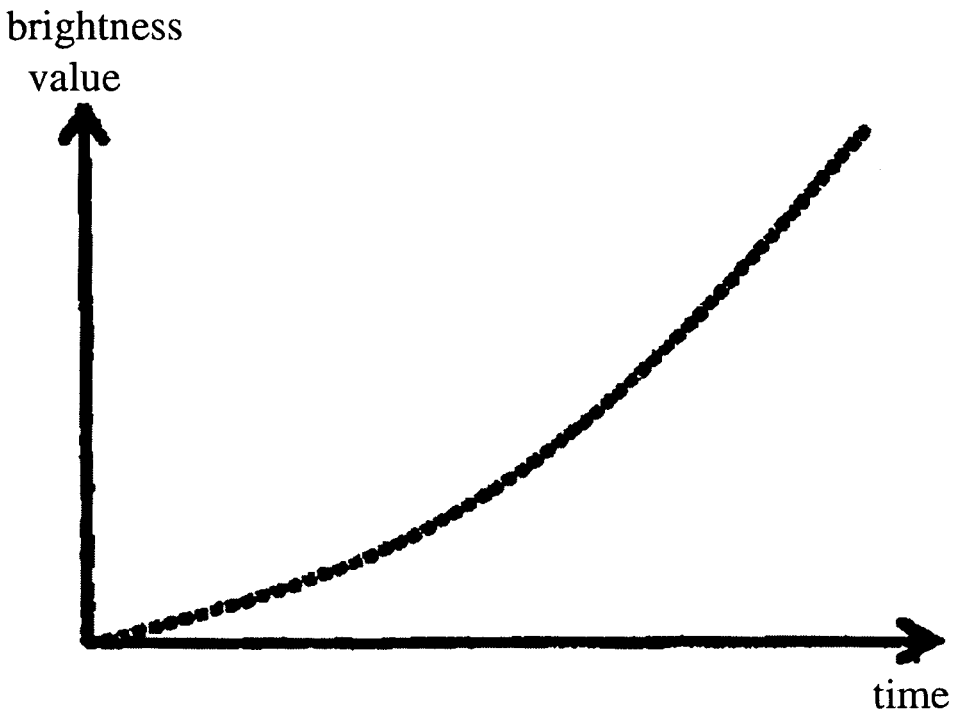
FIG. 3*b* is a graph of the changing of an ideal brightness value when the picture is changing from black to white in the prior art.
Figure 3C:
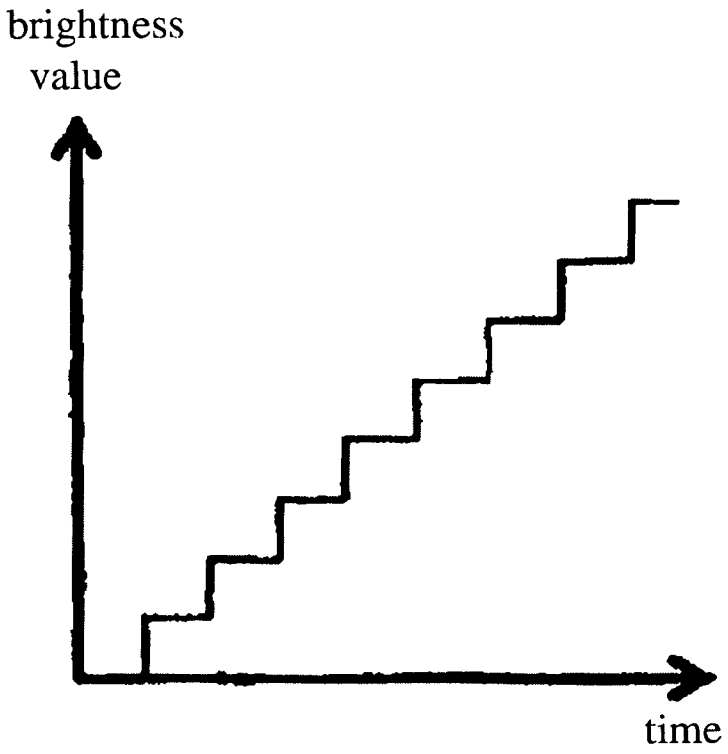
FIG. 3*c* is a graph of the changing of an actual brightness value when the picture is changing from black to white in the prior art.

10: array substrate
20: data driver
30: scan driver
40: timing controller
50: compensation processor
51: data analysis module
52: data compensation module
53: back light control module
54: pulse generator module
55: back light linear filtering module
60: back lights
70: inverter
80: transformer
100: system
551: brightness value comparison unit
552: instruction control unit
553: instruction generation unit

DETAILED DESCRIPTION OF EMBODIMENTS OF THE INVENTION

Figure 4:
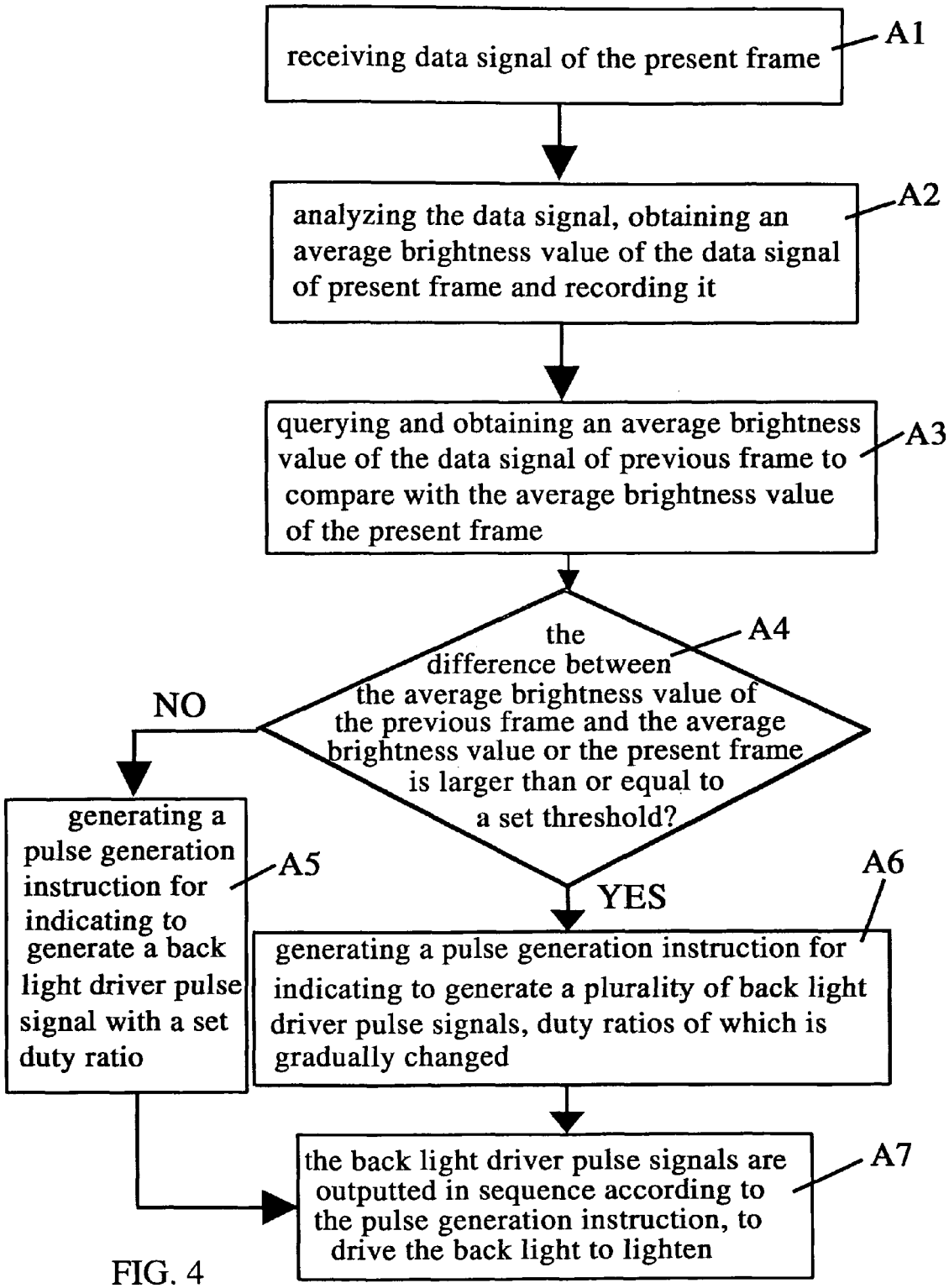
FIG. 4 is a flow chart of an embodiment of the driving method for LCD of the present invention.
Figure 5A:
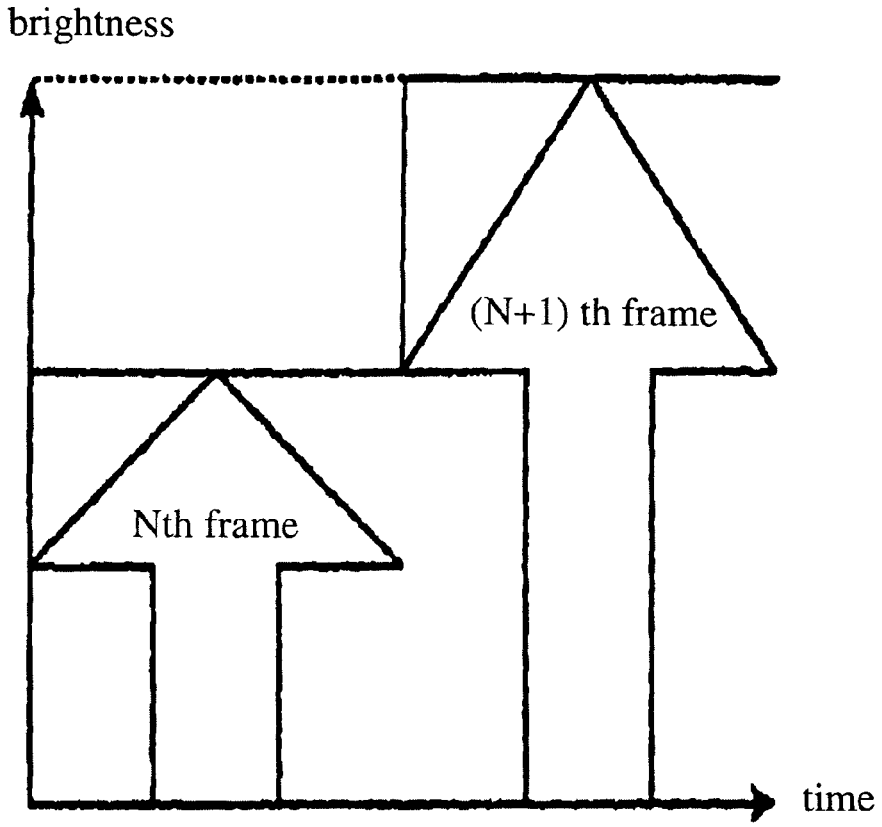
FIG. 5*a* is a schematic diagram for a comparison in the case of the brightness of the back lights being not adjusted in an embodiment of the driving method for LCD of the present invention.
Figure 5B:
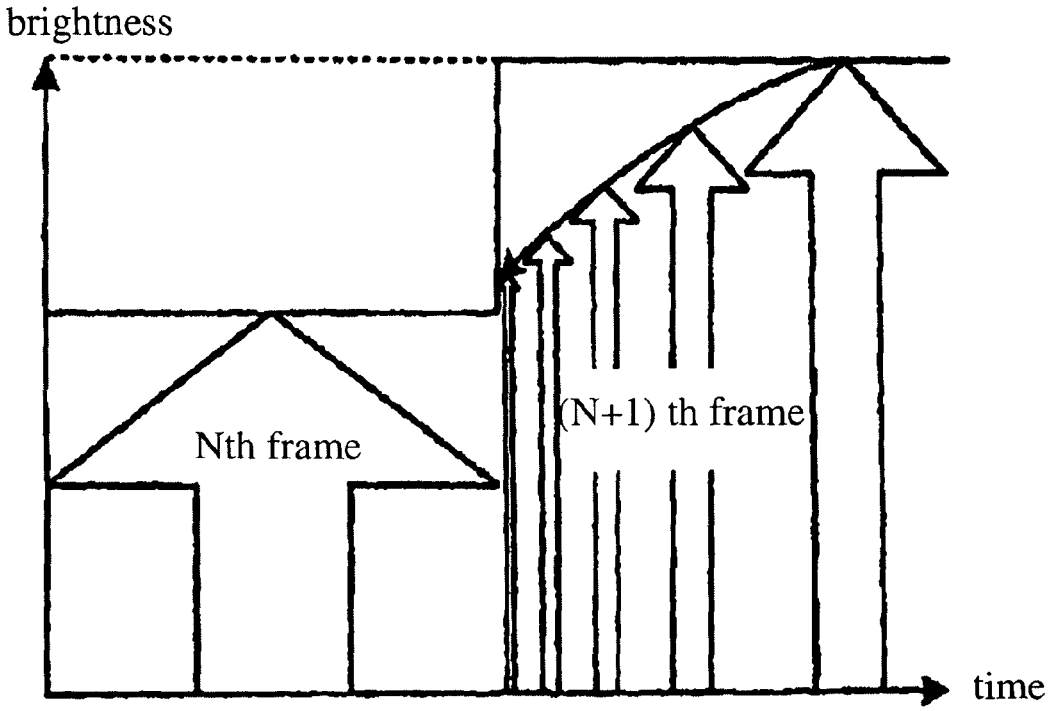
FIG. 5*b* is a schematic diagram for a comparison in the case of the brightness of the back lights being adjusted, in an embodiment of the driving method for LCD of the present invention.

FIG. 4 is a flow chart of an embodiment of the driving method for LCD of the present invention, the driving method is adapted to realize the driving of the back lights in the procedure of the LCD driving, the steps are:

Step A1: the compensation processor receives three primary colors (R, G, B) data signal from the system, while the timing controller receives the synchronous signal from the system, and the transformer receives a power voltage from the system;

Step A2: the compensation makes spectrum analysis on the data signal, obtains an average brightness value of the present frame and records the average brightness value of the present frame;

Step A3: the compensation processor queries and obtains an average brightness value of the previous frame and the average brightness value of the present frame, and compares the average brightness value of the present frame with the average brightness value of the previous frame;

Step A4: the compensation processor judges whether or not a difference between the average brightness value of the previous frame and the average brightness value of the present frame is larger than or equal to a set threshold. The setting base of the set threshold is whether or not the difference between the average brightness values can be viewed by an observer, that is, whether or not the difference between the average brightness values will cause the flickering of the LCD. If the result of the judgment is "no", step A5 is performed, and if the result of the judgment is "yes", step A6 is performed;

Step A5: at this time, the difference between the average brightness values of the previous frame and the present frame is smaller than the set threshold. The compensation processor generates a pulse generation instruction according to duration and the average brightness value of the present frame, as well as the compensation adjustment on the data signal, for indicating the pulse generator module to generate a back light driver pulse signal corresponding to a duty ratio, thus driving the back lights to lighten at a set brightness. FIG. 5*a* shows the average brightness values of the previous frame and the present frame in the case of the back light being lighten, wherein the present frame is denoted as (N+1)th frame, and the previous frame is denoted as Nth frame. Then step A7 is performed;

Step A6: at this time, the difference between the average brightness values of the previous frame and the present frame is larger than or equal to the set threshold, that is, the difference of brightness can be viewed by an observer as the flickering. Meanwhile, a pulse generation instruction is correspondingly generated, for indicating to generate at least two back light driver pulse signals in sequence. At most 4096 back light driver pulse signals may be output, but preferably 10-20 back light driver pulse signals are output in consideration of the cost and display effect of the driving. Each of the back light driver pulse signals has a duty ratio, and the relation between the duty ratios of the respective back light driver pulse signals is a unidirectional gradual changing, and the direction of the unidirectional gradual changing is the same as the direction of the average brightness value of the previous frame gradually changing to the average brightness value of the present frame. FIG. 5*b* shows the procedure of the varying of the brightness of the back lights driven by such back light driver pulse signals, wherein the average brightness value of the (N+1)th frame is larger than the average brightness value of the Nth frame, and the difference between the average brightness values is larger than the set threshold, thus a plurality of back light driver pulse signals are inserted into the duration of the (N+1)th frame. The duty ratios of the back light driver pulse signals increment gradually in a uni-direction, which can drive the back lights to vary brightness gradually. If the average brightness value of the (N+1)th frame is smaller than the average brightness value of the Nth frame, the duty ratios of the back light driver pulse signals decrement gradually in a uni-direction, as long as the gradual changing direction of the duty ratios of the back light driver pulse signals is the same as the gradual changing direction between the average brightness values of the previous frame and the present frame;

Step A7: the back light driver pulse signals are generated according to the pulse generation instruction, and the back light driver pulse signals are output to the inverter in sequence to drive the back lights to lighten.

In the procedure of driving the back lights in the embodiment, the compensation processor meanwhile makes compensation for the data signal according to the result of the analysis, transmits it to the data lines, and transmits the scan pulse to gate electrode scan lines, thus completing the image display of the present frame in cooperation. After that, the above flow is repeated to complete the successive image display.

In the embodiment, the number of the generated back light driver pulse signals within one frame can be set according to the difference between the average brightness values of the previous frame and the present frame. If the difference is small, the number of the generated back light driver pulse signals may be less. In a preferable embodiment, the following steps can be employed to embody the above steps A4 and A6:

Step A41: obtaining the difference between the average brightness value of the previous frame and the average brightness value of the present frame;

Step A42: comparing the difference with a plurality of the set thresholds values of which decrease in sequence;

Step A43: when it is judged that the difference is larger than or equal to the set threshold for current comparison, step A6 is performed, and when it is judged that the difference is smaller than the smallest set threshold, step A5 is performed;

Step A6': generating the pulse generation instruction corresponding to the set threshold for current comparison, for indicating to generate a set number of the back light driver pulse signals in sequence, wherein the relation between the duty ratios of the respective back light driver pulse signals is a unidirectional gradual changing, and the direction of the unidirectional gradual changing is the same as the direction of the average brightness value of the previous frame gradually changing to the average brightness value of the present frame.

The detailed realization of the above steps may be that: assuming that 5 decrementing set thresholds are set. The difference is firstly compared with the set largest threshold, and if the difference is larger than the set threshold, it shows that the difference between the brightness values is large, thus it is required to generate more back light driver pulse signals. If the difference is smaller than the set largest threshold, the difference keeps being compared with the set smaller threshold, thus it shows that the number of the generated back light driver pulse signals can be small. By comparison in sequence, when the difference is compared with the last threshold and the difference is still smaller than the threshold, it shows that the difference between the brightness values can not be viewed by an observer, thus only one back light driver pulse signal may be output.

In the solution of the embodiment, when the dynamic contrast technology is employed to compensate for the data signal, the back light driver pulse signals are divided into a plurality of pulse signals of which the duty ratios are changing gradually, and the gradual changing of the brightness of the back lights is realized. Thus, the difference of the brightness of the back lights corresponding to the difference between the duty ratios of the neighboring back light driver pulse signals is decreased, thus the flickering of the image display of LCD due to the sudden varying of the brightness of the back lights in the dynamic contrast technology can be eliminated. The above solution can not only improve the dynamic contrast of a picture, but also eliminate the flickering. Further, the solution avoids the back lights from reaching high brightness unnecessarily, thus can reduce the power consumption of driving the back lights.

Figure 6:
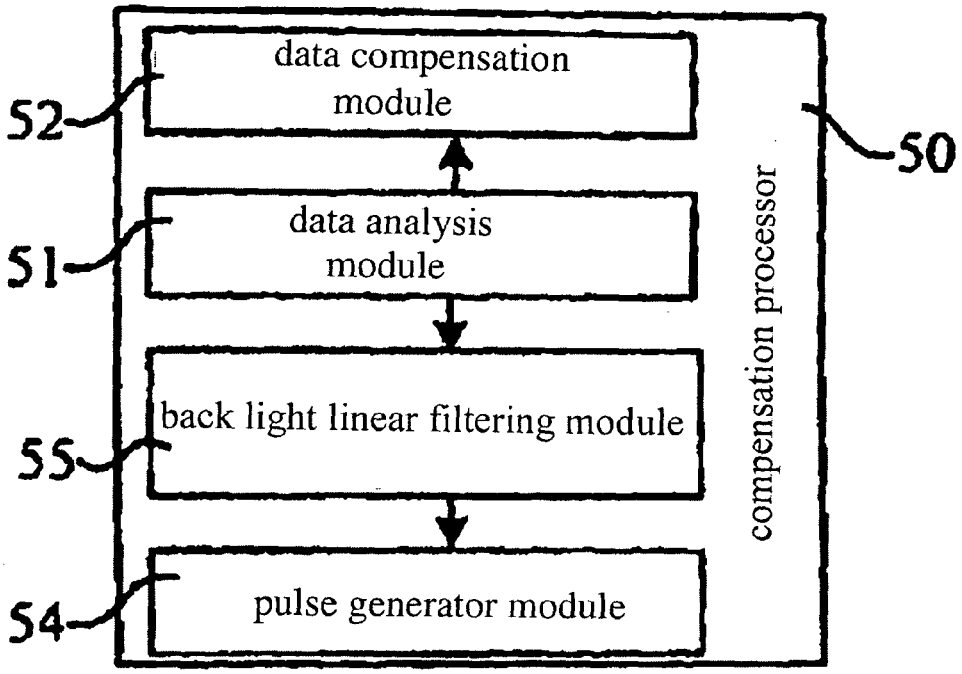
FIG. 6 is a structural schematic diagram of an embodiment of the compensation processor for LCD of the present invention.

FIG. 6 is a structural schematic diagram of an embodiment of the compensation processor for LCD of the present invention. The compensation processor 50 can be applied in the driver device of LCD, for making compensation process on the data signal and back light driver pulses. The compensation processor 50 comprises: a data analysis module 51, a data compensation module 52, a back light linear filtering module 55 and a pulse generator module 54. The data analysis module 51 is for receiving the data signal of the present frame from the system 100, and making a spectrum analysis on the data signal, thus obtaining and recording the average brightness value of the present frame. The data compensation module 52 is connected with the data analysis module 51, and for generating data compensation signal according to the result of the spectrum analysis, and outputting it to the data driver 20 of LCD. The back light linear filtering module 55 is connected with the data analysis module 51, and for obtaining an average brightness value of the previous frame to compare with the average brightness value of the present frame, and when the result of the comparison is that the difference between the average brightness value of the previous frame and the average brightness value of the present frame is larger than or equal to a set threshold, generating a pulse generation instruction indicating to generate at least two back light driver pulse signals in sequence. The relation between the duty ratios of the respective back light driver pulse signals is a unidirectional gradual changing, and the direction of the unidirectional gradual changing is the same as the direction of the average brightness value of the previous frame gradually changing to the average brightness value of the present frame. If the difference is smaller than the set threshold, the generated pulse generation instruction indicates to generate a back light driver pulse signal at set brightness. The pulse generator module 54 is connected with the back light linear filtering module 55, and for generating back light driver pulse signals according to the pulse generation instruction, and outputting each of the back light driver pulse signals to drive the back lights 60 to lighten.

Figure 7:
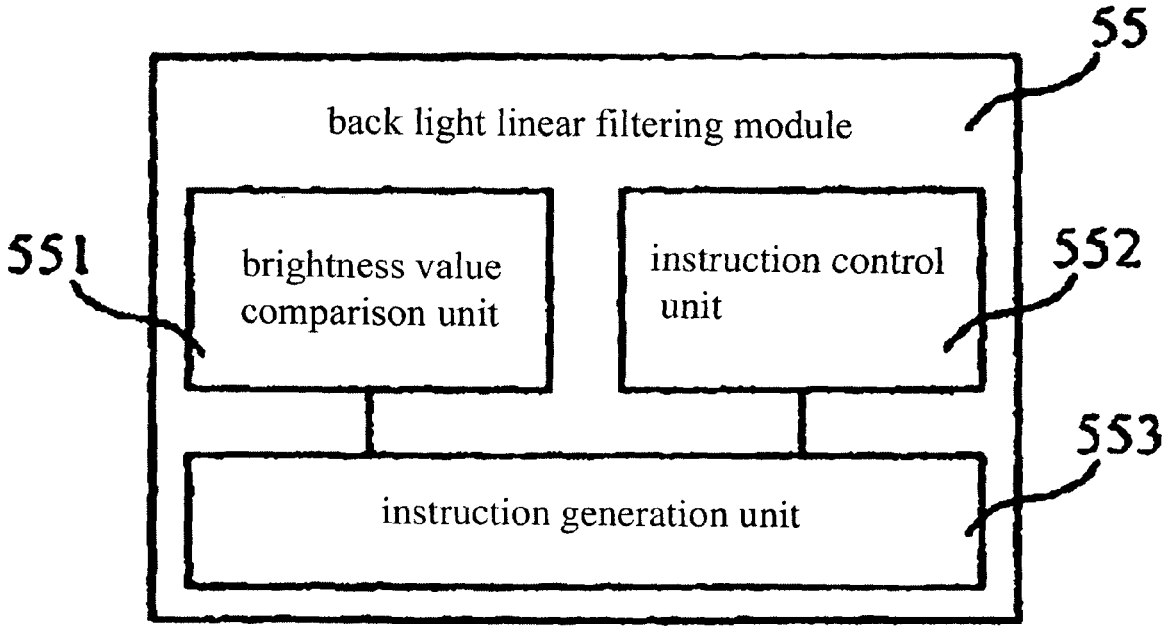
FIG. 7 is a structural schematic diagram of the back light linear filtering module in an embodiment of the compensation processor for LCD of the present invention.

In the embodiment, the structure of the back light linear filtering module 55 is shown in FIG. 7, and further comprises: a brightness value comparison unit 551, an instruction control unit 552, and an instruction generation unit 553. Wherein, the brightness value comparison unit 551 is connected with the data analysis module 51, and for obtaining the average brightness value of the previous frame and the average brightness value of the present frame for comparing to obtain a difference. The instruction control unit 552 is for storing a plurality of decrementing set thresholds in sequence, and storing the pulse generation instruction indicating the number of the generated back light driver pulse signals corresponding to each of the set thresholds. The instruction generation unit 553 is connected with the brightness value comparison unit 551 and the instruction control unit 552, and for comparing the difference with the plurality of decrementing set thresholds in sequence, and when it is judged that the difference is larger than or equal to the set threshold for current comparison, querying and obtaining the corresponding pulse generation instruction corresponding to the set threshold for current comparison, for indicating to generate a set number of back light driver pulse signals in sequence. The relation between the duty ratios of the respective back light driver pulse signals is a unidirectional gradual changing, and the direction of the unidirectional gradual changing is the same as the direction of the average brightness value of the previous frame gradually changing to the average brightness value of the present frame. The solution can complete the corresponding control by setting a program in the instruction control unit 552.

The compensation processor for LCD in the embodiment can employ the solution of any embodiment of the driving method for LCD of the present invention. The gradual changing of the brightness of the back lights is realized by adjusting the back light driver pulse signals, and the difference of the brightness of the back lights corresponding to the difference between the duty ratios of the neighboring back light driver pulse signals is decreased, thus the flickering of the image display of LCD due to the sudden varying of the brightness of the back lights is eliminated.

Figure 8:
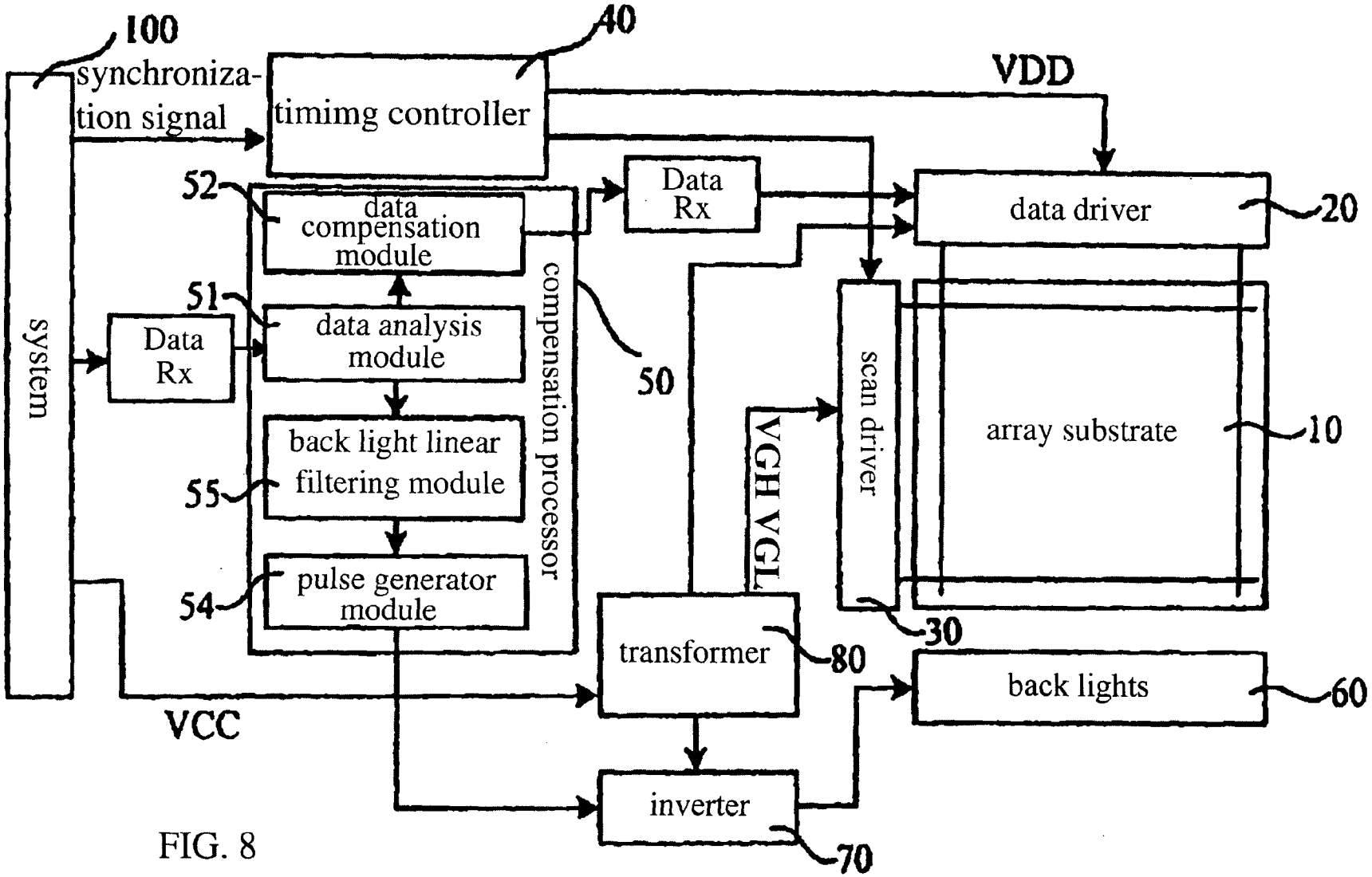
FIG. 8 is a structural schematic diagram of an embodiment of the driver device for LCD of the present invention.

FIG. 8 is a structural schematic diagram of an embodiment of the driver device for LCD of the present invention. The driver device includes: a data driver 20 comprising a plurality of data driver IC connected with the data lines respectively, for providing the data signal to data lines; a scan driver 30 comprising a plurality of gate driver IC connected with the gate electrode scan lines respectively, for providing the scan pulse to the gate electrode scan lines; an inverter 70 connected with each of the back lights 60 respectively, for making transformation between DC and AC to control the back lights 60, wherein the inverter 70 drives the back lights 60 to lighten and control the brightness of the back lights 60, and the back lights 60 emits light at a set brightness according to the control of the inverter 70; a timing controller 40 connected with the data driver 20 and the scan driver 30 respectively, for generating the timing signal to control the data driver 20 and the scan driver 30, wherein the timing controller 40 generates data timing signals required for the data driver 20 and scan timing signals required for the scan driver 30 according to the synchronous signals including horizontal synchronous signal, vertical synchronous signal, and data enable signal; a transformer 80 connected with the data driver 20, the scan driver 30, and the inverter 70 respectively, for converting an input high voltage to a voltage required for the liquid crystal panel to provide to respective sections; further a compensation processor 50 connected with the data driver 20 and the inverter 70 respectively, wherein the compensation processor 50 can employ the solution of any embodiment of the compensation processor for LCD of the present invention. The data compensation module 52 of the compensation processor 50 is connected with the data driver 20, and the pulse generator module 54 of the compensation processor 50 is connected with the inverter 70.

The driver device for LCD in the embodiment can employ the solution of any embodiment of the compensation processor for LCD of the present invention. The gradual changing of the brightness of the back lights is realized by adjusting the back light driver pulse signals, and the difference of the brightness of the back lights corresponding to the difference between the duty ratios of the neighboring back light driver pulse signals is decreased, thus the flickering of the image display of LCD due to the sudden varying of the brightness of the back lights is eliminated.

Those skilled in the art would appreciate that all or part of the steps for realizing the above method embodiments an be implemented by a hardware related to program instruction, the program can be stored in a computer-readable storage medium, and when executed, the program can perform the steps comprising the above method embodiments. The storage medium includes a medium such as ROM, RAM, magnetic disk, or optical disk and so on, which can store program codes.

It is noted that the above embodiments are only for explaining the technical solution of the invention, but not for limitation. Although the invention has been described in details with reference to the preferred embodiments, those skilled in the art would appreciate that the technical solution of the invention can be modified, or a part of technical features therein can be replaced, without departing from the spirit and scope of the technical solutions of the embodiments of the invention.

The invention claimed is:

1. A driving method for LCD, characterized in that comprising:

Step 1 of receiving data signal of a present frame, making spectrum analysis on the data signal, and obtaining and recording an average brightness value of the present frame;

Step 2 of acquiring the average brightness value of the present frame, and querying an average brightness value of the previous frame to compare with the average brightness value of the present frame;

Step 3 of when the result of the comparison is that the difference between the average brightness value of the previous frame and the average brightness value of the present frame is larger than or equal to a set threshold, generating a pulse generation instruction indicating to generate, during the present frame, at least two back light driver pulse signals in sequence, wherein the relation between the duty ratios of the respective back light driver pulse signals in the at least two back light driver pulse signals to be generated during the present frame is a unidirectional gradual changing relative to time, and the direction of the unidirectional gradual changing relative to time is the same as the direction of the gradual changing of the average brightness value of the previous frame relative to the average brightness value of the present frame; and Step 4 of generating the at least two back light driver pulse signals during the present frame according to the pulse generation instruction, and outputting each of the at least two back light driver pulse signals in sequence during the present frame to drive the back lights.

2. The driving method for LCD according to claim 1, characterized in that said step 3 comprising:

Step 31 of obtaining the difference between the average brightness value of the previous frame and the average brightness value of the present frame;

Step 32 of comparing the difference with a plurality of decrementing set thresholds; and Step 33 of when it is judged that the difference is larger than or equal to the set threshold for current comparison, generating the pulse generation instruction corresponding to the set threshold for current comparison, for indicating to generate a set number of the back light driver pulse signals in sequence, wherein the relation between the duty ratios of the respective back light driver pulse signals is a unidirectional gradual changing, and the direction of the unidirectional gradual changing is the same as the direction of the average brightness value of the previous frame gradually changing to the average brightness value of the present frame.

3. The driving method for LCD according to claim 1, characterized in that the range of the number of the generated back light driver pulse signals is 10 to 20.

4. The driving method for LCD according to claim 2, characterized in that the range of the number of the generated back light driver pulse signals is 10 to 20.

5. A compensation processor for LCD, characterized in that comprising:

a data analysis module for receiving data signal of a present frame, making a spectrum analysis on the data signal, and obtaining and recording an average brightness value of the present frame;

a data compensation module connected with the data analysis module, for generating data compensation signal according to the result of the spectrum analysis, and outputting the generated data compensation signal to a data driver of the LCD;

a back light linear filtering module connected with the data analysis module, for obtaining an average brightness value of the previous frame to compare with the average brightness value of the present frame, and when the result of the comparison is that a difference between the average brightness value of the previous frame and the average brightness value of the present frame is larger than or equal to a set threshold, generating a pulse generation instruction indicating to generate, during the present frame, at least two back light driver pulse signals in sequence, wherein the relation between the duty ratios of the respective back light driver pulse signals in the at least two back light driver pulse signals generated during the present frame is unidirectional gradual changing relative to time, and the direction of the unidirectional gradual changing relative to time is the same as the direction of the gradual changing of the average brightness value of the previous frame relative to the average brightness value of the present frame; and a pulse generator module connected with the back light linear filtering module, for generating the at least two back light driver pulse signals during the present frame according to the pulse generation instruction, and outputting each of the at least two back light driver pulse signals in sequence during the present frame to drive the back lights.

6. The compensation processor for LCD according to claim 5, characterized in that the back light linear filtering module comprising:

a brightness value comparison unit connected with the data analysis module, for obtaining the average brightness value of the previous frame and the average brightness value of the present frame to compare for obtaining a difference;

an instruction control unit for storing a plurality of decrementing set thresholds in sequence, and storing the pulse generation instruction indicating the number of the generated back light driver pulse signals corresponding to each of the set thresholds; and an instruction generation unit connected with the brightness value comparison unit and the instruction control unit, for comparing the difference with the plurality of decrementing set thresholds in sequence, and when it is judged that the difference is larger than or equal to the set threshold for current comparison, querying and obtaining a corresponding pulse generation instruction corresponding to the set threshold for current comparison, for indicating to generate a set number of back light driver pulse signals in sequence, wherein the relation between the duty ratios of the respective back light driver pulse signals is unidirectional gradual changing, and the direction of the unidirectional gradual changing is the same as the direction of the average brightness value of the previous frame gradually changing to the average brightness value of the present frame.

7. A driver device utilizing the compensation processor for LCD of claim 5, comprising: a data driver; a scan driver; an inverter; a timing controller connected with the data driver and the scan driver respectively; a transformer, characterized in that the data compensation module of the compensation processor being connected with the data driver; the pulse generator module of the compensation processor being connected with the inverter.

8. A driver device utilizing the compensation processor for LCD of claim 6, comprising: a data driver; a scan driver; an inverter; a timing controller connected with the data driver and the scan driver respectively; a transformer, characterized in that the data compensation module of the compensation processor being connected with the data driver; the pulse generator module of the compensation processor being connected with the inverter.

* * * * *